US011375747B2

(12) United States Patent
Gerding

(10) Patent No.: US 11,375,747 B2
(45) Date of Patent: Jul. 5, 2022

(54) SMOKING PIPE

(71) Applicant: Rowdy Monkeys, LLC, Wadsworth, OH (US)

(72) Inventor: Christopher Gerding, Wadsworth, OH (US)

(73) Assignee: Rowdy Monkeys, LLC, Wadsworth, OH (US)

( * ) Notice: Subject to any disclaimer, the term of this patent is extended or adjusted under 35 U.S.C. 154(b) by 632 days.

(21) Appl. No.: 16/290,062

(22) Filed: Mar. 1, 2019

(65) Prior Publication Data

US 2020/0275691 A1 Sep. 3, 2020

(51) Int. Cl.

| | |
|---|---|
| ***A24F 1/16*** | (2006.01) |
| ***A24F 7/00*** | (2006.01) |
| ***A24F 1/32*** | (2006.01) |

(52) U.S. Cl.

CPC ..... *A24F 1/16* (2013.01); *A24F 1/32* (2013.01); *A24F 7/00* (2013.01)

(58) Field of Classification Search

CPC ..... A24F 1/16; A24F 1/22

See application file for complete search history.

(56) References Cited

U.S. PATENT DOCUMENTS

| | | | | |
|---|---|---|---|---|
| 1,649,714 | A | 4/1924 | Lord | |
| 3,709,233 | A | 1/1973 | Stelitano | |
| 4,774,970 | A | 10/1988 | Bell | |
| 5,464,026 | A | 11/1995 | Gardner | |
| 8,496,048 | B2 | 7/2013 | Krasnov | |
| 2009/0114372 | A1 | 5/2009 | Ippoushi | |
| 2009/0288670 | A1 * | 11/2009 | Lee | A23G 3/56 131/330 |
| 2016/0324211 | A1 | 11/2016 | Yankelevich | |

FOREIGN PATENT DOCUMENTS

| | | | | |
|---|---|---|---|---|
| GB | 190915914 A | * | 7/1910 | A24F 1/16 |
| GB | 567332 A | * | 2/1945 | A24F 1/16 |

OTHER PUBLICATIONS

Icky_Stick, Internet article, Feb. 28, 2019, 10 pages.

* cited by examiner

*Primary Examiner* — Eric Yaary

(57) ABSTRACT

A smoking pipe is provided. The smoking pipe includes an upper housing with a lower housing removably attached to the upper housing. An insert is located between the upper housing and the lower housings so that the upper and lower housings and the insert form an interior channel that directs air introduced to the interior channel to move toward a user, then away from the user, then toward the user again.

20 Claims, 9 Drawing Sheets

SMOKING PIPE

FIELD OF THE INVENTION

The present invention generally relates to devices for smokers and methods of use. More particularly, the invention concerns a method and apparatus for smoking tobacco and other materials.

BACKGROUND OF THE INVENTION

Human use of smoking pipes has been dated back thousands of years. Most pipes comprise a bowl where tobacco or other material is deposited. The bowl is located at one end of a hollow tube, with a mouthpiece located at the other end of the tube. The tobacco or other material is ignited, and the user inhales the smoke emitted by the burning material at the mouthpiece. This basic smoking pipe has many shortcomings, the two primary ones being inhalation of smoke that is "hot" and along with the smoke, embers or ashes from the burning material are also inhaled.

Countless modifications have been developed in attempts to decrease the temperature of the smoke, and eliminate embers and ashes from reaching the mouthpiece. Some designs have been more successful than others. However, there still remains a need to overcome these, and other shortcomings in the above-described, existing art.

The discussion of the background to the invention included herein is included to explain the context of the invention. This is not to be taken as an admission that any of the material referred to was published, known or part of the common general knowledge as at the priority date of the claims.

Figure 1:
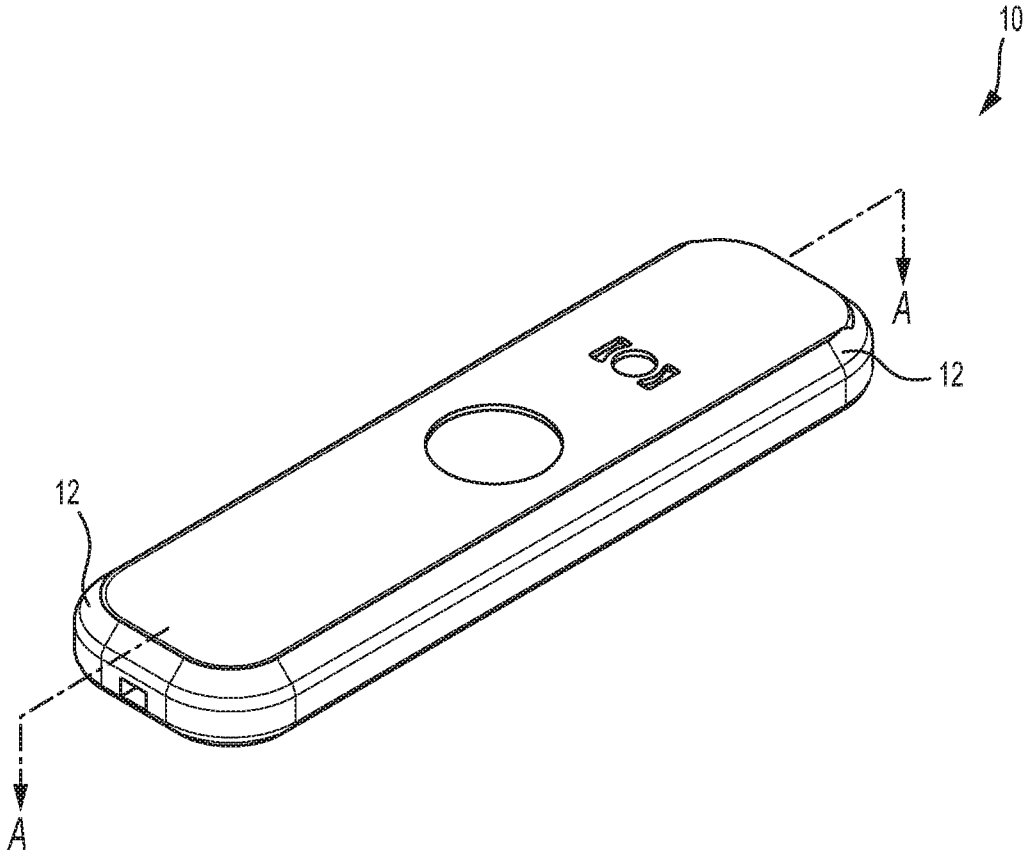
FIG. 1 is a perspective view of one embodiment of the smoking pipe embodying the principals of the invention.

It will be recognized that some or all of the Figures are schematic representations for purposes of illustration and do not necessarily depict the actual relative sizes or locations of the elements shown. Unless otherwise specifically noted, articles depicted in the drawings are not necessarily drawn to scale. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following description, for the purposes of explanation, numerous specific details are set forth in order to provide a thorough understanding of the smoking pipe, or apparatus that embodies principals of the present invention. It will be apparent, however, to one skilled in the art that the smoking apparatus may be practiced without some of these specific details. Throughout this description, the embodiments and examples shown should be considered as exemplars, rather than as limitations on the smoking apparatus. That is, the following description provides examples, and the accompanying drawings show various examples for the purposes of illustration. However, these examples should not be construed in a limiting sense as they are merely intended to provide examples of the smoking apparatus rather than to provide an exhaustive list of all possible implementations of the smoking apparatus.

Unless defined otherwise, all technical and scientific terms used herein have the same meaning as is commonly understood by one of skill in the art to which this invention belongs. In event the definition in this section is not consistent with definitions elsewhere, the definitions set forth in this section will control.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments. In this description, the directional prepositions of front, back, top, upper, bottom, lower, left, right and other such terms refer to the device as it is oriented and appears in the drawings and are used for convenience only.

Figure 2:
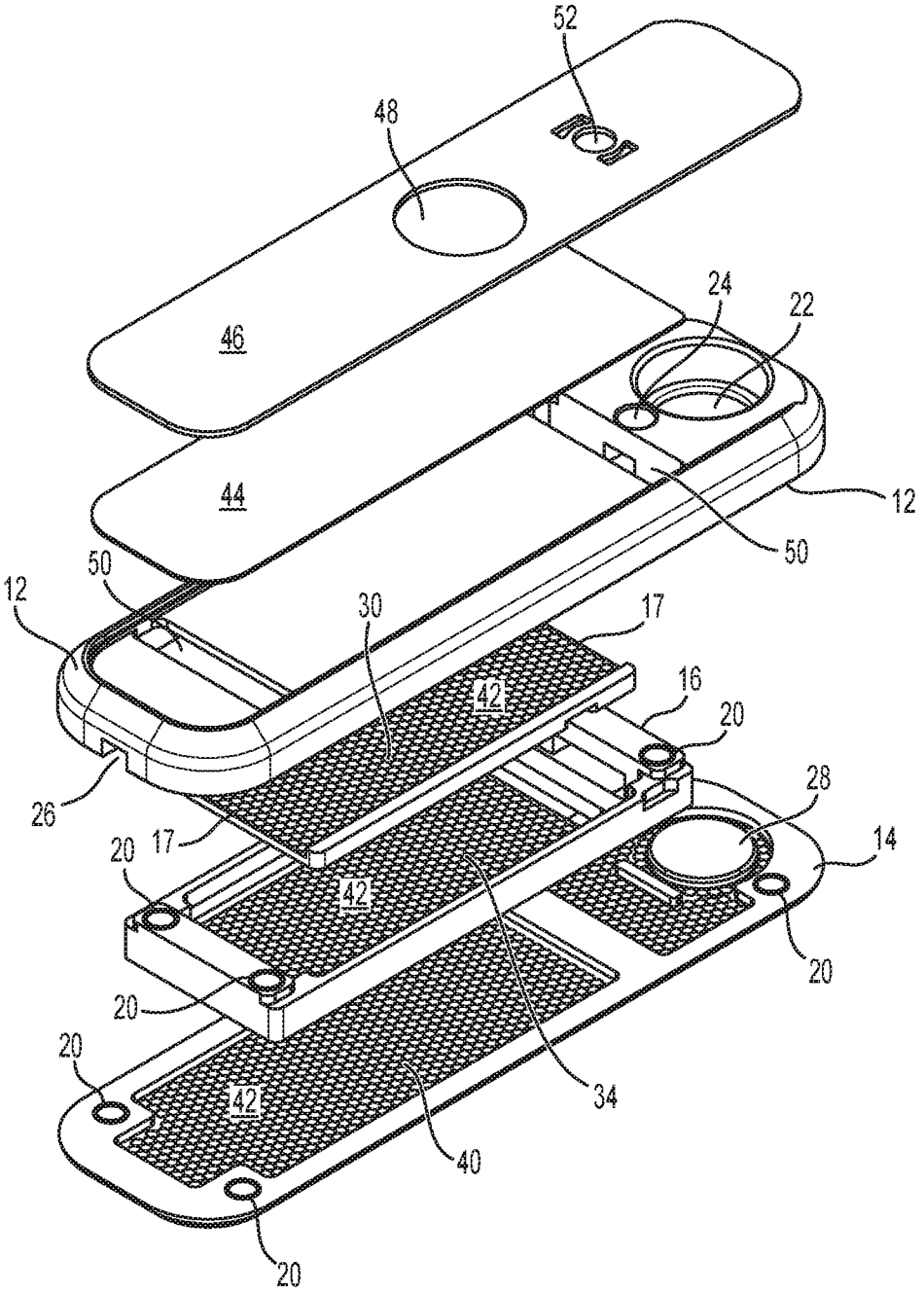
FIG. 2 is an perspective exploded view of the embodiment of FIG. 1.
Figure 3:
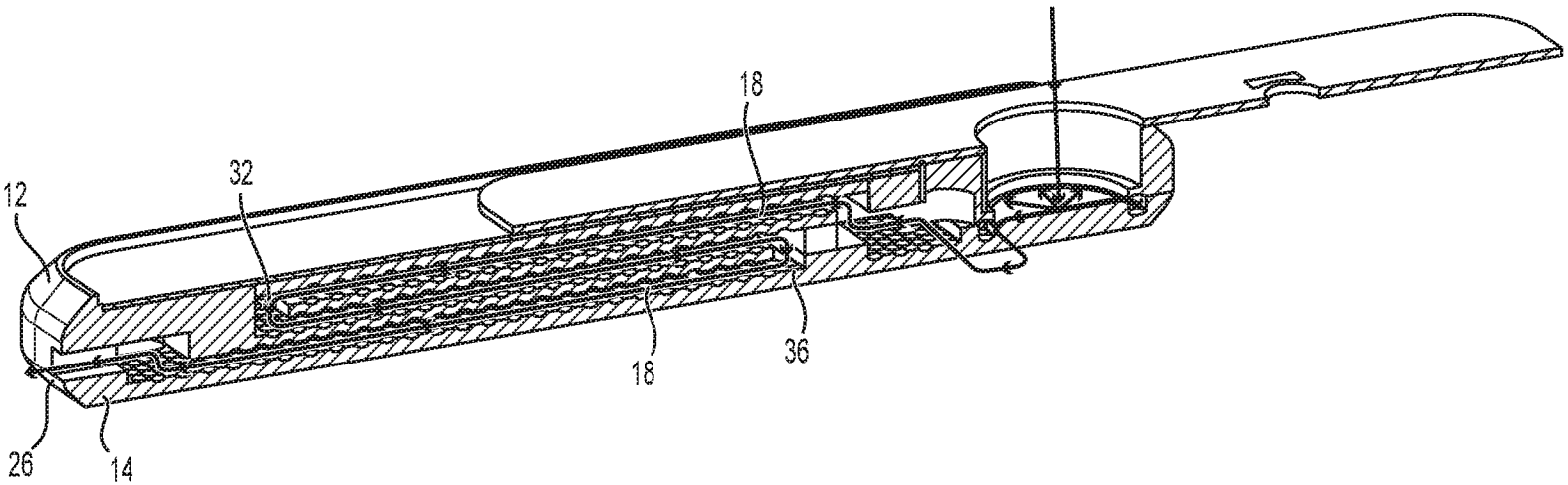
FIG. 3 is a perspective sectional view taken along cutting plane A-A of FIG. 1, with a slide element in a deployed position.
Figure 4:
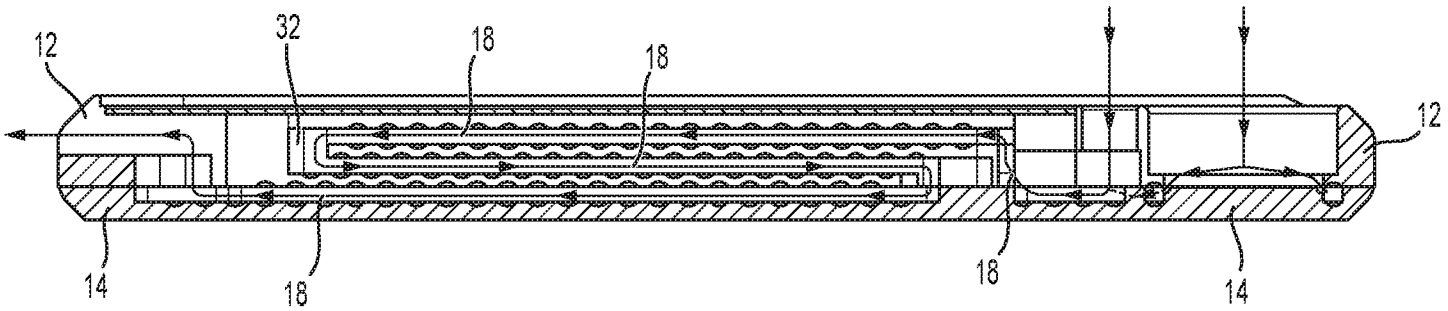
FIG. 4 is a side elevation sectional view taken along cutting plane A-A of FIG. 1.

Referring now to FIGS. 1-9, the smoking pipe, or apparatus 10 is illustrated. The figures show a preferred embodiment comprising a rectangular aluminum body having an upper housing 12, a lower housing 14 removably coupled to the upper housing 12 and a large insert 16 removably located between the upper housing 12 and the lower housing 14. One feature of the present invention is that the upper housing 12 and the lower housing 14 and the large insert 16 are structured to form a serpentine interior channel 18 that allows air introduced to the interior channel 18 to move toward a user, then away from the user, then toward the user again. This is shown in FIGS. 3 and 4.

In a preferred embodiment, the upper housing 12 and lower housing 14 are held together by magnets 20, shown in FIG. 2. The magnets are located on the upper housing 12 and the lower housing 14. The method of attachment of the parts of the smoking pipe 10 is not critical as long as it can serve the natural need to disassemble the smoking pipe 10 for the occasional cleaning of its internal surfaces. Screws, clamps, complementary magnets, or other means can be used to keep the parts of the smoking pipe 10 together.

Figure 5:
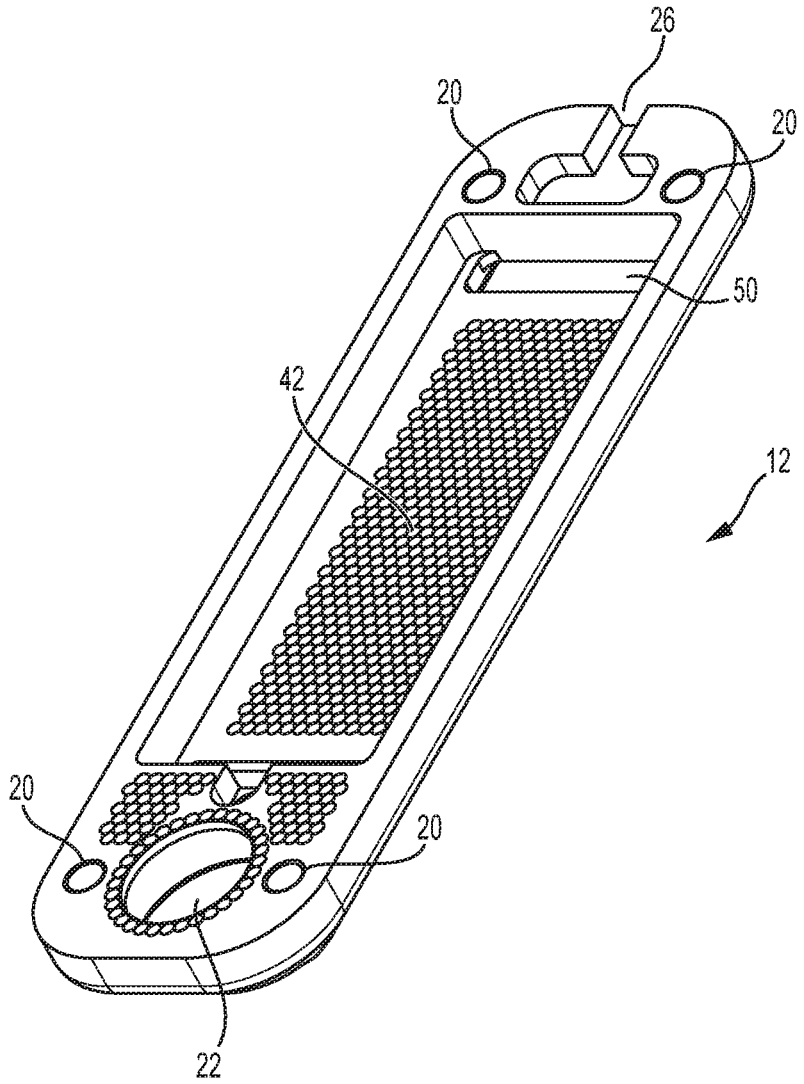
FIG. 5 is a perspective bottom view of the upper housing shown in FIG. 2.

As shown in FIG. 5, the upper housing 12 has four magnets 20 that are attached by glue, or other means. The lower housing 14 also has four magnets 20 that are also glued or otherwise attached to the lower housing 14, as shown in FIG. 2. As is well known, a magnet attracts itself to the opposite pole of another magnet. For example, a magnet's south pole will attach itself to the north pole of another magnet. This feature is used to magnetically couple the upper housing 12 to the lower housing 14. One feature of this novel arrangement is that the smoking pipe 10 can be quickly and easily disassembled to that each part can be cleaned thoroughly.

The upper housing 12 features three openings, or apertures. A large opening, or aperture 22 for receiving tobacco, and a small opening, or aperture 24 that can function as a secondary air passage (i.e., a "carb"), or as a holder for a cigarette. The third opening, or mouthpiece aperture 26 functions as the mouthpiece where a user would place their lips.

Referring now to FIG. 2, the lower housing 14 includes the four magnets 20 discussed above that magnetically couple the lower housing 14 to the upper housing 12. The lower housing also includes a tapered circle 28 that helps negate the need for a metal screen. During use, when tobacco, or other smoking material is placed in the large opening 22, or bowl, and ignited, tobacco particles are trapped in the large opening as the tapered circle 28 causes airflow to be directed around the entire circumference of the base of the large opening 22. This is a novel feature of the smoking pipe 10 as conventional pipes pull air from the center of the bowl. This feature of the smoking pipe 10 greatly improves uniformity of tobacco ignition.

Figure 6:
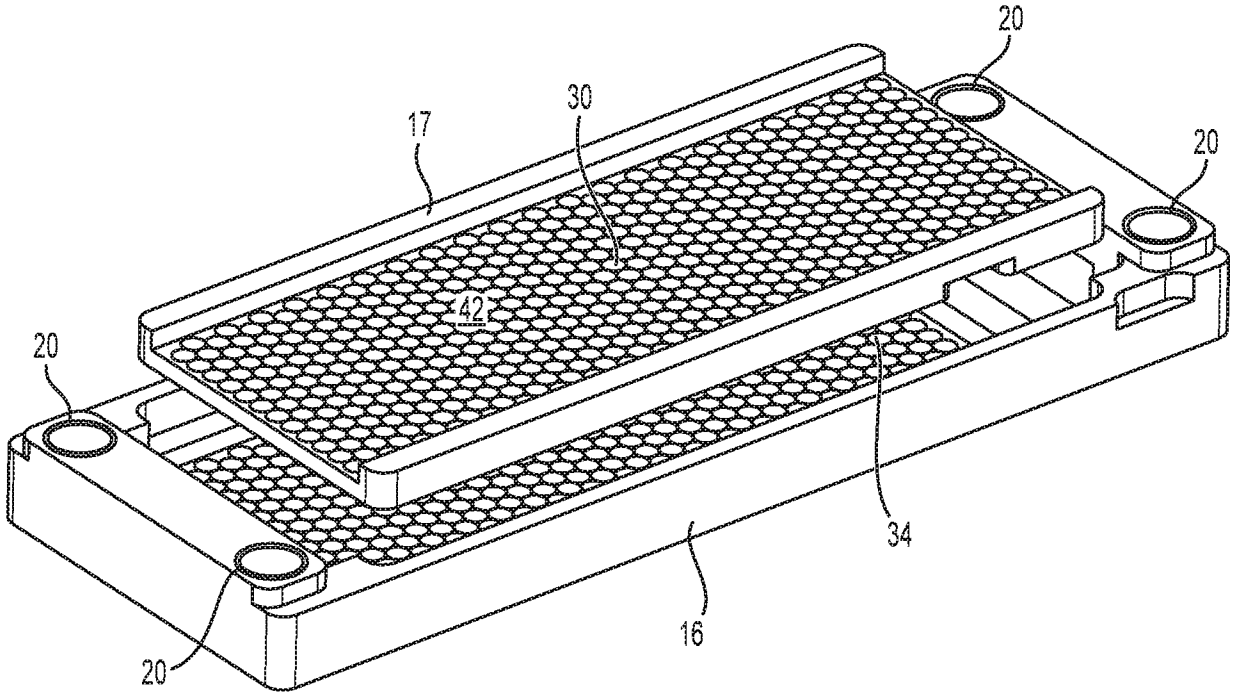
FIG. 6 is a perspective view of the large insert and the small insert shown in FIG. 2.
Figure 7:
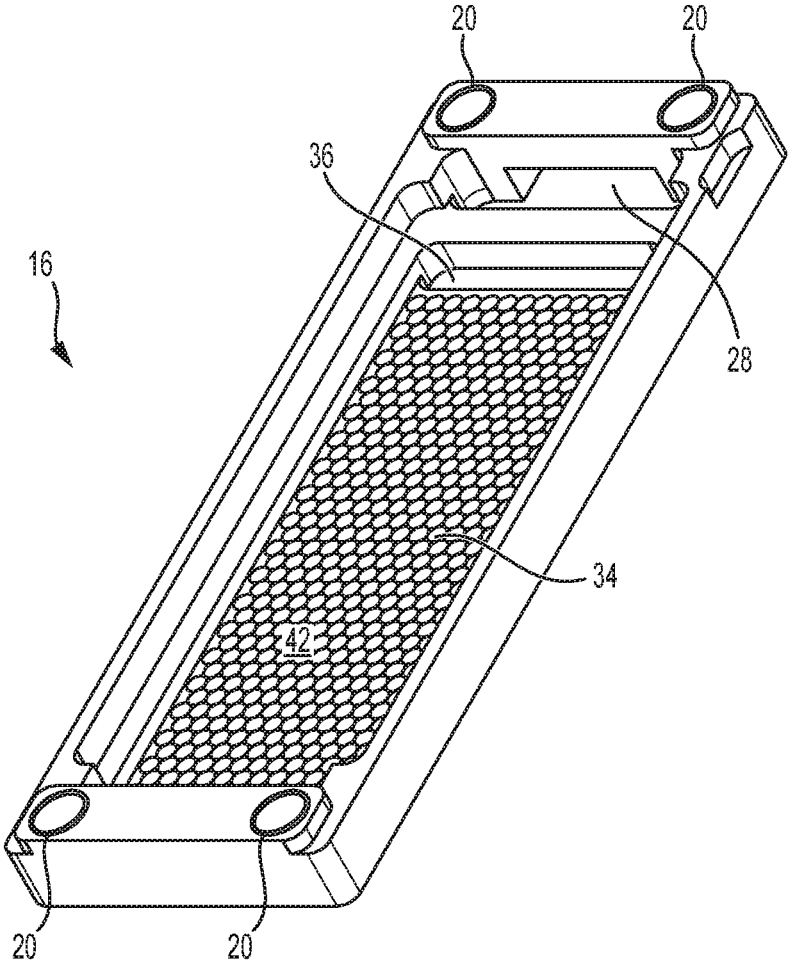
FIG. 7 is a perspective top view of the large insert shown in FIG. 6.
Figure 8:
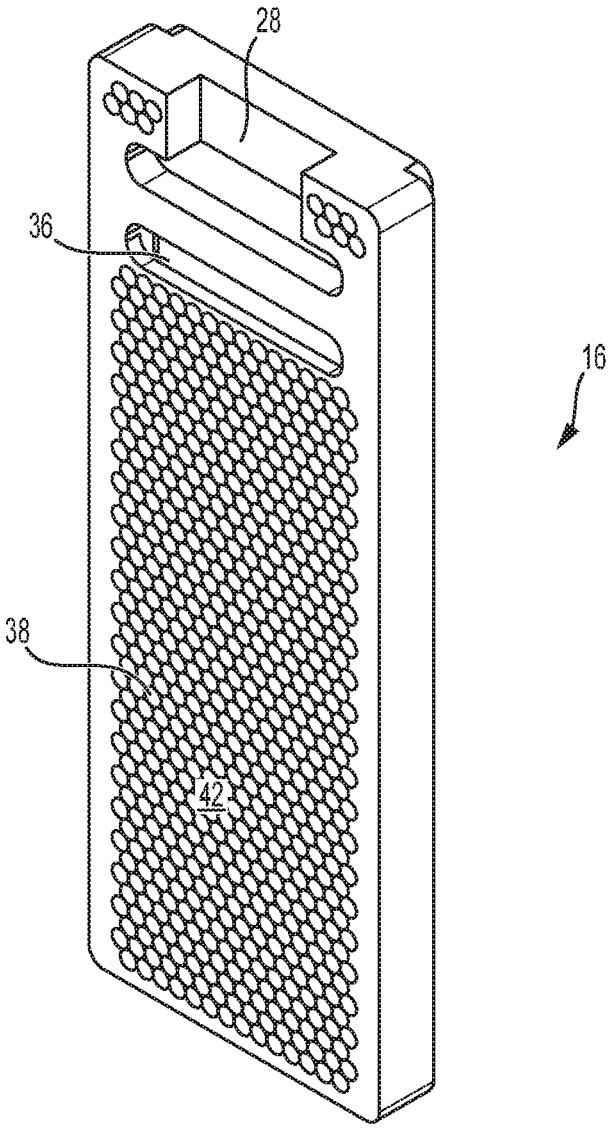
FIG. 8 is a perspective bottom view of the large insert shown in FIG. 6.

Referring now to FIGS. 6-8, the large insert 16 is illustrated. The large insert 16 includes four magnets 20 that have their polarity, or poles arranged so that they repel, rather than attract the magnets in the upper housing 12. As a result of this magnet polarity arrangement, the large insert 16 is ejected from the upper housing 12 by the repelling force of the magnets 20.

The upper housing 12, lower housing 14 and the insert 16 form an interior channel 18, or serpentine pathway shown in FIGS. 3-4 that channels air passing from the large opening, or bowl 22 to the mouthpiece opening 26. Specifically, air enters the large opening 22 and proceeds through large insert aperture 28, shown in FIG. 8. The air then proceeds along the small insert upper surface 30. The small insert 17 is sized so that a gap 32 is formed between a distal end of the small insert 17 and an adjacent portion of the large insert 16, shown in FIGS. 3-4.

The air proceeding from the large opening 22, having passed along the small insert upper surface 30, reverses direction by passing through the gap 32, and proceeds between the lower surface of the small insert 17 and the large insert upper surface 34, shown in FIGS. 2-4 and 6.

The air, proceeding between the lower surface of the small insert 17 and the large insert upper surface 34 reaches slot 36, shown in FIGS. 7-8. Slot 36 is formed in the large insert 16, and the air passes through the slot 36 and again reverses direction, now proceeding between the large insert lower surface 38 and the lower housing upper surface 40.

Finally, as shown in FIGS. 3-4, the air proceeds between the large insert lower surface 38 and the lower housing upper surface 40, and exits at the mouthpiece opening 26.

The interior channel 18, or serpentine flow path described above is a novel feature of the smoking pipe 10. One advantage of the serpentine flow path is that smoke flowing along the pathway is cooled before it reaches the mouthpiece opening 26. Smoke travels through three layers of dimples 42 before reaching the mouthpiece opening 26. In one embodiment, each dimple 42 comprises a segment of a sphere of radii 5/64 inches, with a depth of 1/64 inches. As illustrated, the dimples 42 are located on the upper housing 12 (lower surface), lower housing 14 (upper surface), large insert 16 (both upper and lower surfaces) and small insert 17 (both upper and lower surfaces).

The dimples 42 increase the surface area of the interior channel 16 and the interior channel 18, or serpentine pathway increases the exposure time of the smoke to the dimples 42 for maximum heat exchange, thereby cooling the smoke. The serpentine flow path also eliminates the risk of particles reaching mouthpiece opening 26, which means in a preferred embodiment, a screen is not required in the large opening, or bowl 22. However, it will be appreciated that a screen (not shown) may be positioned in the bowl 22. In one embodiment the bowl 22 may have a volume of 0.1745 cubic inches.

The components comprising the smoking pipe 10, namely the upper housing 12, lower housing 14 and the insert 16 are "stacked" in a very compact arrangement that maximizes surface area while keeping the smoking pipe 10 small enough to fit in a pocket. For example, in one embodiment, the smoking pipe 10 may have a dimension of 5.75 inches long, 1.5 inches wide and 0.5 inches tall. This allows the smoking pipe 10 to fit in a standard eyewear case.

Also, different materials may be employed to maximize the heat exchange properties of the smoking pipe 10. For example, one embodiment may be constructed of aluminum, but other embodiments may be constructed of brass, bronze, copper, silver, gold, platinum and their alloys having a high thermal conductivity coefficient.

Referring now to FIG. 2, a graphics or art insert 44 is included in the smoking pipe 10. The graphics insert 44 is removeable when the slide cover 46 is removed. The graphics insert 44 is interchangeable so that a variety of custom graphic options may be displayed through the slide cover large aperture 48. The graphics insert 44 is held in place by the magnetic field between the slide cover 46 and large insert 16.

The slide cover 46 is comprised of a ferrous material so that it is attracted to an magnetic field. As shown in FIG. 2, the magnets 20 in the large insert 16 are positioned in rectangular apertures 50 in the upper housing 12 when the smoking pipe 10 is assembled. The magnets 20 attract the slide cover 46, which captures the graphics insert 44 and the large insert 16, thereby keeping the large insert 16 captured in the upper housing 12. When the lower housing 14 is removed, the large insert 16 will remain captured within the upper housing 12. To remove the large insert 16, and small insert 17, the slide cover 46 is removed.

Figure 9:
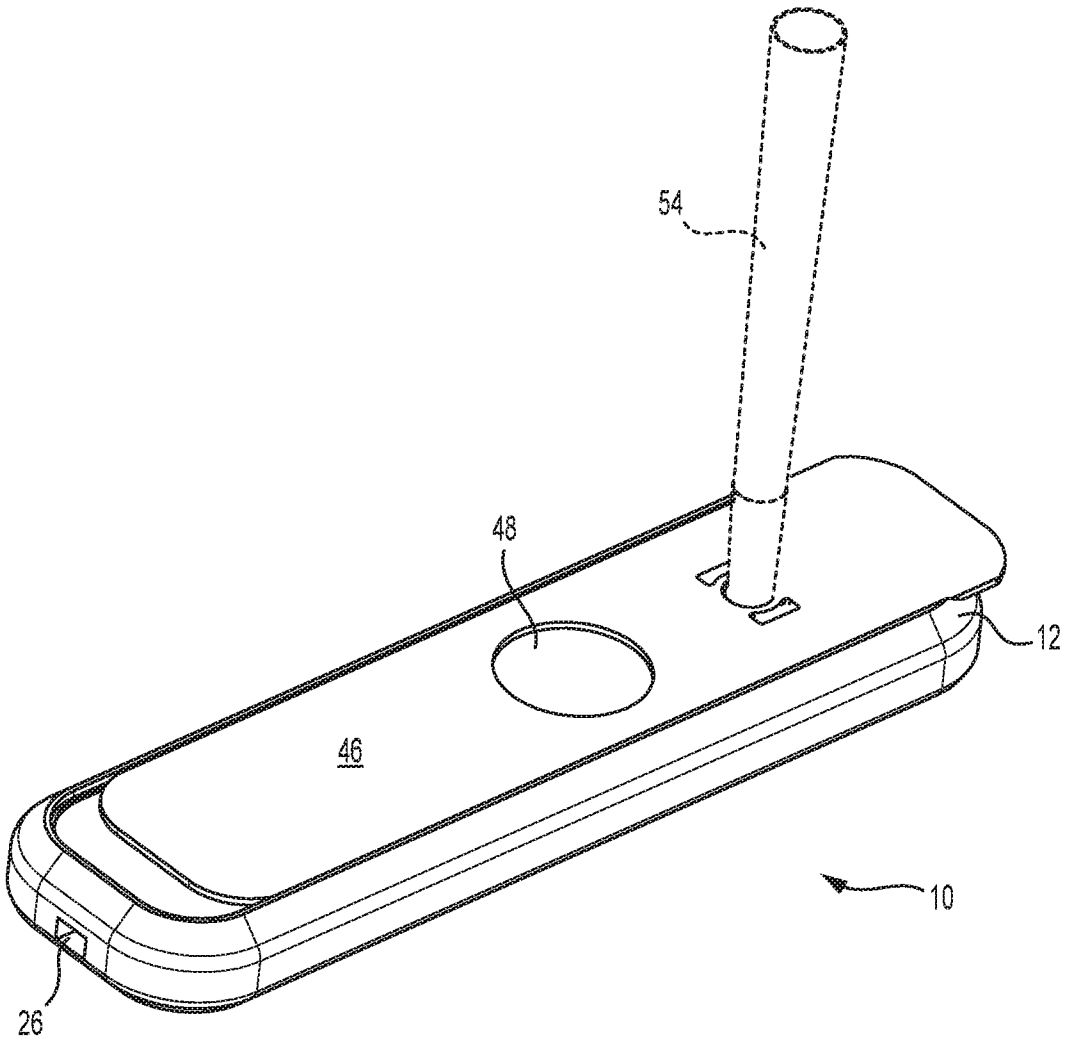
FIG. 9 is a perspective top view of the embodiment of FIG. 1, with a cigarette inserted in one opening.

Referring now to FIGS. 2 and 9, the slide cover 46 includes a slide cover small aperture 52. The slide cover small aperture 52 can be aligned with the small opening 24 in the upper housing 12, so that air can be drawn through the small opening 24. This air would pass through the interior channel 18, or serpentine pathway of the smoking pipe 10 as described above, and shown in FIGS. 3-4.

As shown in FIG. 9, a cigarette 54 may be inserted through the slide cover small aperture 52 and into small opening 24 so that a user may smoke a cigarette 54 using the smoking pipe 10.

Alternatively, the slide cover small aperture 52 can be used to clear smoke or air from the interior channel 18, or serpentine pathway. For example, a user would push the slide cover 46 to align the slide cover large aperture 48 with the large opening 22. Tobacco, or other smoking products in the large opening 22 would be ignited. Smoke may remain in the interior channel 18 after the smoking process. The user would then move the slide cover 46 to align either the slide cover large aperture 48 or the slide cover small aperture 52 with the small opening 24. The user would then inhale through the mouthpiece opening 26. The small opening 24 bypasses the large opening 22, and air flows through the interior channel 18 thereby clearing the smoking pipe 10 of any residual smoke.

It is to be noticed that the term "comprising", used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means. Finally, the terms "a", "an" and "the" mean "one or more", unless expressly specified otherwise.

Thus, it is seen that a smoking apparatus is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. A smoking pipe, comprising:

an upper housing comprising a first and a second aperture, with both apertures located at a distal end;

a lower housing removably coupled to the upper housing;

an insert located between the upper and lower housings;

with the upper and lower housings and the insert structured to form an interior channel that directs air from the first aperture, then to the upper housing, then around the insert, then to the lower housing; and a third aperture located in a moveable cover slideably positioned on the upper housing so that the third aperture can be positioned selectively over either the first or second apertures.

2. The smoking pipe of claim 1, where the insert includes a removeable element that forms a portion of the interior channel.

3. The smoking pipe of claim 1, where the insert includes a plurality of magnets each generating a magnetic field that attracts a cover located on the upper housing so that the insert is removably held in the upper housing by the magnetic field.

4. The smoking pipe of claim 1, where each of the upper and lower housings includes a plurality of magnets each generating a magnetic field that attract each other so that the upper housing and lower housing are removably coupled together by the magnetic field.

5. The smoking pipe of claim 1, where the smoking pipe is made from a material selected from a group consisting of: an aluminum, a brass; a bronze; a copper; a silver; a gold; a platinum; an alloy of aluminum; an alloy of steel; an alloy of brass; an alloy of bronze; an alloy of copper; an alloy of silver; an alloy of gold; an alloy of platinum; and a combination of two or more thereof.

6. The smoking pipe of claim 1, where at least one surface of each of the upper housing, lower housing and the insert include a plurality of dimples.

7. A smoking pipe, comprising:

an upper housing having a first aperture located at a first distal end, and a second aperture located at a second distal end;

a lower housing removably coupled to the upper housing;

a third aperture located adjacent to the first aperture;

a moveable cover slideably positioned on the upper housing and including a fourth aperture, so that the fourth aperture can be positioned selectively over either the first or third apertures;

an insert located between the upper and lower housings;

with the upper and lower housings and the insert structured to form an interior channel that directs air from the first aperture, then to the upper housing, then around the insert, then to the lower housing.

8. The smoking pipe of claim 7, where the insert further comprises:

a first plate element positioned next to the upper housing; and a second plate element positioned next to the first plate element, and adjacent to the lower housing.

9. The smoking pipe of claim 7, where the insert includes a plurality of magnets each generating a magnetic field that attracts a cover located on the upper housing so that the insert is removably held in the upper housing by the magnetic field.

10. The smoking pipe of claim 7, where each of the upper and lower housings includes a plurality of magnets each generating a magnetic field that attract each other so that the upper housing and lower housing are removably coupled together by the magnetic field.

11. The smoking pipe of claim 7, where the smoking pipe is made from a material selected from a group consisting of: an aluminum; a brass; a bronze; a copper; a silver; a gold; a platinum; an alloy of aluminum; an alloy of steel; an alloy of brass; an alloy of bronze; an alloy of copper; an alloy of silver; an alloy of gold; an alloy of platinum; and a combination of two or more thereof.

12. The smoking pipe of claim 7, where at least one surface of each of the upper housing, lower housing and the insert include a plurality of dimples.

13. A smoking pipe, comprising:

an upper housing comprising a first and a second aperture, with both apertures located at a distal end;

a lower housing removably coupled to the upper housing;

an insert located between the upper and lower housings;

with the upper and lower housings and the insert structured to form an interior channel that directs air from the first aperture, then to the upper housing, then around the insert, then to the lower housing and out a fourth aperture located at a second distal end of the upper housing; and a third aperture located in a moveable cover slideably positioned on the upper housing so that the third aperture can be positioned selectively over either the first or second apertures.

14. The smoking pipe of claim 13, where each of the upper housing, lower housing and the insert are substantially rectangular and planar in shape.

15. The smoking pipe of claim 13, where at least one surface of each of the upper housing, lower housing and the insert include a plurality of dimples.

16. The smoking pipe of claim 13, where the insert includes a plurality of magnets each generating a magnetic field that attracts a cover located on the upper housing so that the insert is removably held in the upper housing by the magnetic field.

17. The smoking pipe of claim 13, where each of the upper and lower housings includes a plurality of magnets each generating a magnetic field that attract each other so that the upper housing and lower housing are removably coupled together by the magnetic field.

18. The smoking pipe of claim 1, where the first aperture is sized to receive a material for smoking, and the second aperture is located adjacent to the first aperture, with the second aperture sized to receive a material for smoking in a form of an elongated cylinder.

19. The smoking pipe of claim 7, where the first aperture is sized to receive a material for smoking, and the second aperture is a mouthpiece.

20. The smoking pipe of claim 13, where the first aperture is sized to receive a material for smoking, and the fourth aperture is a mouthpiece.

* * * * *